United States Patent [19]

Martinon et al.

[11] 4,388,739

[45] Jun. 21, 1983

[54] WASHING BAG FOR CURTAINS, DRAPES AND THE LIKE

[76] Inventors: Gérard R. Martinon, 3, rue de la Terrace; Jean-Louis Dayme, 38, rue Franklin, both of Lyons (Rhône); Roger J. Martinon, Lieu dit "Les Forets", Lachassagne (Rhône), all of France

[21] Appl. No.: 234,806

[22] Filed: Feb. 17, 1981

[30] Foreign Application Priority Data

Feb. 18, 1980 [FR] France ..... 80 03878
Jan. 6, 1981 [FR] France ..... 81 00357

[51] Int. Cl.[3] ..... D06F 35/00

[52] U.S. Cl. ..... 8/150; 68/235 R; 150/11

[58] Field of Search ..... 8/150, 159; 68/213, 68/235 R; 150/11; 229/63

[56] References Cited

U.S. PATENT DOCUMENTS

| | | | |
|---|---|---|---|
| 618,943 | 2/1899 | Kahnweiler | 150/11 X |
| 1,564,930 | 12/1925 | Boyes . | |
| 1,703,620 | 2/1929 | Hamilton . | |
| 1,937,544 | 12/1933 | Cameron et al. | 8/150 X |
| 2,009,035 | 7/1935 | Towers . | |
| 2,080,252 | 5/1937 | Cook . | |
| 2,132,734 | 10/1938 | Hart et al. . | |
| 2,296,449 | 9/1942 | Meisenheimer | 68/235 R |
| 2,645,920 | 7/1953 | Venn | 68/235 R |
| 3,151,345 | 10/1964 | Massop | 8/150 |

FOREIGN PATENT DOCUMENTS

| | | | |
|---|---|---|---|
| 169373 | 11/1951 | Austria | 150/11 |
| 692028 | 6/1940 | Fed. Rep. of Germany . | |
| 2118764 | 11/1972 | Fed. Rep. of Germany . | |
| 2360163 | 6/1975 | Fed. Rep. of Germany . | |
| 18818 | of 1910 | United Kingdom . | |
| 1202996 | 8/1970 | United Kingdom . | |

*Primary Examiner*—Philip R. Coe
*Attorney, Agent, or Firm*—Karl F. Ross; Herbert Dubno

[57] ABSTRACT

A washing bag for curtains, drapes and the like, has a net fabric and is formed at its mouth with two spaced-apart ties (drawstrings) adapted to define a compartment between them in which the suspension hooks, rings or other attachment of the curtains or drapes can be confined so that removal of these members prior to cleaning is not necessary and nevertheless the hooks and like members do not endanger the fabric of the curtain or drape during the washing operation.

5 Claims, 4 Drawing Figures

WASHING BAG FOR CURTAINS, DRAPES AND THE LIKE

FIELD OF THE INVENTION

Our present invention relates to a washing bag and, more particularly, to an openwork sack in which articles to be agitated in contact with a cleaning liquid can be received to effect washing and which protects the fabric during the washing operation. The invention especially is directed to washing bags for drapes, curtains and like delicate and sensitive fabrics which may be utilized together with hooks or other means for suspending the fabric.

BACKGROUND OF THE INVENTION

Curtains, drapes, tapestries and wall-decor fabrics and window-treatment fabrics of various type are generally supported on rods, bars or like hardware by hooks, rings or like attachment devices which must be carefully and laboriously removed from and inserted into the fabric article when the article is to be cleaned and rehung.

The cleaning operation may involve drycleaning in which the fabric is agitated in a solvent, or water washing in which it is agitated in contact with water, generally in the presence of a detergent.

Because of the sensitivity of the fabric and the desire to segregate the fabric from others during the washing operation, it is a common practice, especially in commercial cleaning establishments to provide openwork bags or sacks into which the fabric articles are placed and in which the articles are cleaned, i.e. agitated in contact with the cleaning liquid.

To prevent the articles from escaping from such bags or sacks, the latter were usually provided at the mouths with drawstrings or cords which, when tied, constricted the mouth of the sack or bag sufficiently.

Efforts to use conventional washing bags of this type, composed of fabric of a net or reticulate pattern, for the cleaning of draperies with hooks and like attachments affixed thereto have proved to be ineffective because the movement of such elements within the sack caused damage to the article to be cleaned and to the sack itself, raising the possibility of damage to articles in other sacks in the cleaning machine.

Consequently, notwithstanding the protective advantage afforded by the use of cleaning sacks of the type described, the washing of drapery articles of the type described invariably involved the necessity of first removing the hooks or other attachment elements therefrom and the replacement of these elements subsequent to cleaning.

OBJECT OF THE INVENTION

It is the principal object of the present invention to provide a cleaning bag for drapery and like materials which eliminates the drawback discussed above.

SUMMARY OF THE INVENTION

This object and others which will become apparent hereinafter are attained, in accordance with the present invention with a washing bag composed of an openwork fabric and having a mouth provided with a pair of spaced-apart drawstrings defining a compartment between them and in which the hooks or like attachment elements for the drapery fabric can be received and in which these attachment elements can be confined so that they do not contact the fabric of the articles to be cleaned contained in the main compartment of the sack and do not otherwise interfere with the cleaning operation.

The upper drawstring or cord ties the auxiliary hook-receiving compartment so that, even in the event of detachment of a hook or other element from the curtain or drape, the detached member will not pose a danger to fabrics involved in the washing process.

The lower drawstring or cord forms a constriction between this auxiliary compartment and the main compartment of the bag to prevent fabric from the main compartment from moving into the hook-receiving compartment and, conversely, to prevent hooks in the auxiliary compartment from entering the main compartment.

The auxiliary compartment defined between the two spaced-apart drawstrings may be of such size as to confine the hooks against relative movement, thereby eliminating any tendency of the hooks to work their way out of the auxiliary compartment.

According to a feature of the invention, the region between the two drawstrings or closures is formed with a flexible wall of reduced penetrability, thereby further impeding any tendency for the hooks or other suspension elements from working their way out of the auxiliary compartment. Preferably, the internal surface of the openwork sack within the auxiliary compartment is lined with a layer limiting penetration of the hooks to and through the mesh of the fabric openwork lying externally of this lining.

Alternatively, the openwork itself can be formed with a smaller mesh size, or with openings partly spanned by additional or reinforcing threads, which so limit the mesh size in the region of the auxiliary compartment as to prevent penetration by the hooks.

It is also possible to simply double or triple the fabric thickness in this region thereby reinforcing the wall between the two drawstrings.

When a lining is employed, it is preferably disposed along the interior of the openwork fabric so as to limit the tendency of the hooks to catch and thereby facilitate removal of the articles from the back when the washing operation is concluded.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
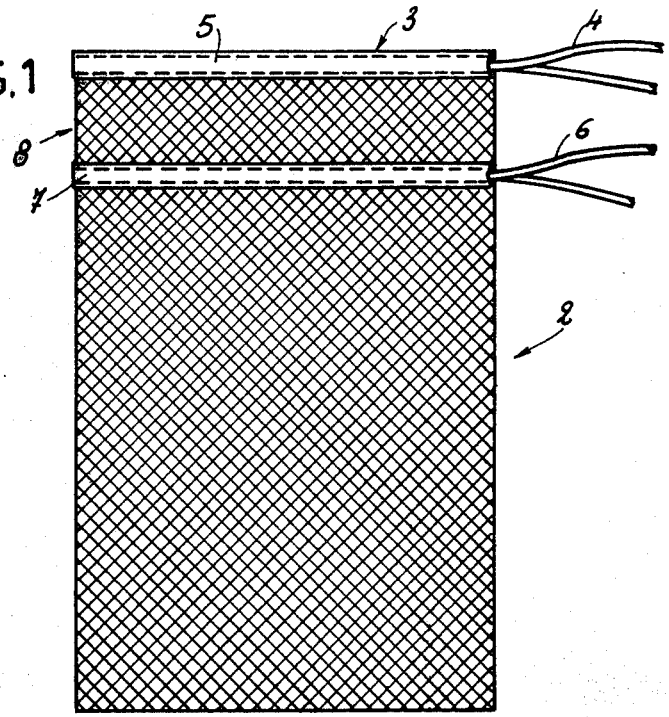
FIG. 1 is a schematic illustration of a flattened washing bag embodying the principles of the present invention.
Figure 2:
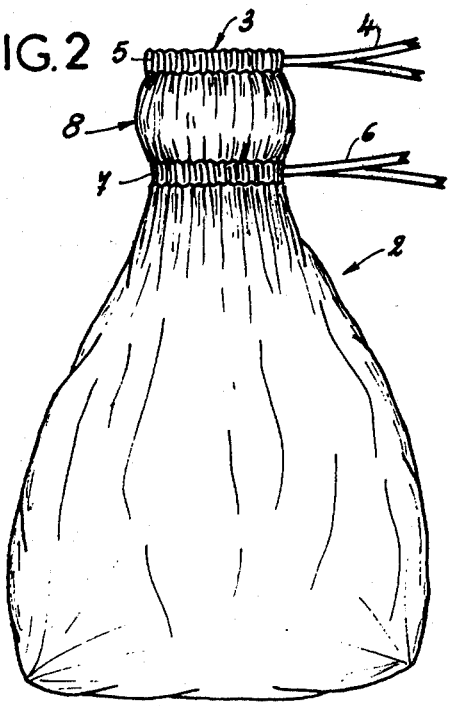
FIG. 2 is an elevational view, also in diagrammatic form, of the bag after filling.

As shown in FIGS. 1 and 2 of the drawing, the bag or sack 2 is composed of an openwork fabric, i.e. a net, having its mouth at its upper end as shown at 3. The mouth 3 is bounded by a first drawstring 4 received within a tubular border 5 which can be drawn closed or shirred as can be seen in FIG. 2 to close this mouth of the bag.

According to the invention, the bag is provided with a second drawstring 6 spaced below the drawstring 4 and also received within a tubular sheath 7 stitched to the bag fabric so that a neck construction can be formed in the bag by tightening the drawstring 6 and shirring the sheath 7 as shown in FIG. 2.

The space within the bag between the two drawstrings or closures 4 and 6 thus defines a compartment 8 which is adapted to receive the attachment members of curtains or drapery articles whose fabric portions are contained within the main compartment of the bag 2 below the drawstring 6. These attachment members may be any conventional drapery hooks or hangers, whether of the open or of the clasp type and of simple or complex (e.g. selfpleating) configuration.

The attachment members are thus confined against movement when the bag is filled (FIG. 2) and neither friction nor like action can cause the hooks to work their way out of the auxiliary compartment 8 when the bag is placed in a tumbling or other type of washing machine.

In use, after the main fabric portions of the articles are introduced into the bag with both drawstrings open and while the hooks are held above the drawstring 6, the latter is tightened, whereupon the hooks are released and drawstring 4 is closed.

Upon removal of the cleaned article, the upper drawstring 4 is untied and the hooks gripped, whereupon drawstring 6 can be untied and the article drawn by the hooks from the bag. The hooks are thus not removed from the drapery fabric and, of course, the size of the auxiliary compartment 8 can be accommodated to receive the number of hooks desired for mounting the article upon the tringle.

Figure 3:
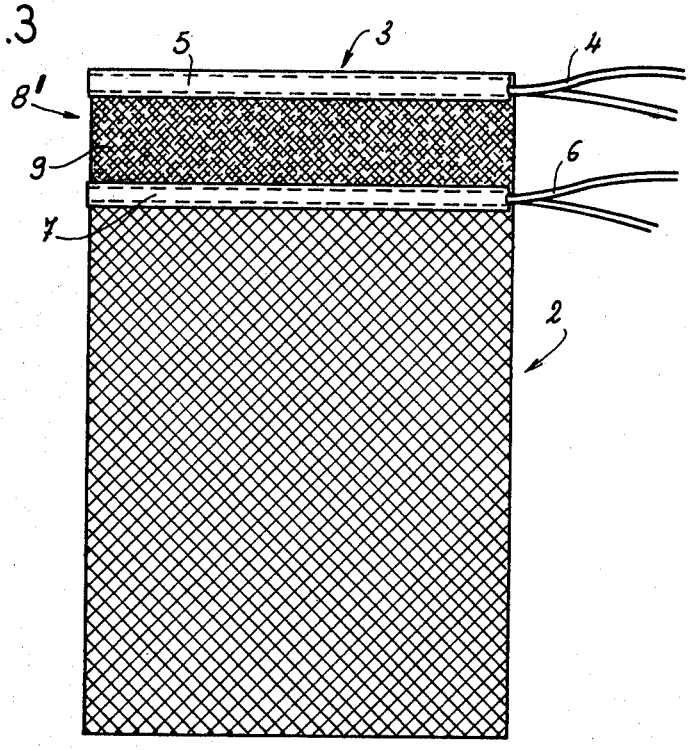
FIG. 3 is a view similar to FIG. 1 illustrating another embodiment of the invention also in diagrammatic form.

FIG. 3 shows an embodiment of the invention in which the wall 9 of the auxiliary compartment 8′ between the two drawstrings 4 and 6 is formed with additional threads to close or span the mesh of the openwork fabric 2 and thereby limit the size of the openings in this region and reduce any tendency of the hooks to penetrate therethrough.

Figure 4:
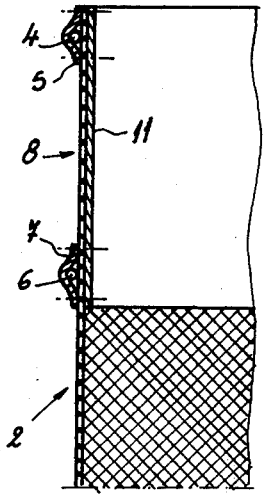
FIG. 4 is a cross section through the mouth region of a bag according to the invention, drawn to a larger scale than FIGS. 1 and 3 and also in highly diagrammatic form.

In the embodiment of FIG. 4, the fabric of the bag is internally lined with a layer 11 which may be of a woven or knit fabric of small mesh size or of some other flexible material of limited penetrability. This lining 11 is advantageously stitched along the interior of the auxiliary compartment 8, preferably by the stitch seams which attach the sheaths 5 and 7 in place.

We claim:

1. A washing bag for the washing of drapery fabric articles with suspension elements attached, comprising an openwork sack composed of a net fabric and formed with a mouth, a first drawstring closure extending around said mouth, a second drawstring closure spaced from said first drawstring closure for constricting a neck of said sack to define between said drawstring closures an auxiliary compartment for said elements, and means for limiting the penetration of said elements through the wall of said auxiliary compartment.

2. The bag defined in claim 1 wherein said means includes additional threads in the net fabric limiting the mesh size thereof at said auxiliary compartment.

3. The bag defined in claim 1 wherein said means includes a flexible layer lining said wall.

4. The bag defined in claim 3 wherein said layer is disposed along the interior of said wall.

5. A method of cleaning a drapery having suspension elements attached which comprises inserting the drapery into a bag as defined in claim 1 while confining said elements in said auxiliary compartment between said drawstring closures and agitating the bag with the drapery therein in contact with a cleaning liquid.

* * * * *